US011300085B2

(12) United States Patent
Zhang et al.

(10) Patent No.: US 11,300,085 B2
(45) Date of Patent: Apr. 12, 2022

(54) METHODS AND SYSTEMS FOR A FUEL INJECTOR

(71) Applicant: Ford Global Technologies, LLC, Dearborn, MI (US)

(72) Inventors: Xiaogang Zhang, Novi, MI (US); Mark Meinhart, Dexter, MI (US); Joseph F. Basmaji, Waterford, MI (US); Jianwen James Yi, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 35 days.

(21) Appl. No.: 16/122,719

(22) Filed: Sep. 5, 2018

(65) Prior Publication Data

US 2020/0072175 A1 Mar. 5, 2020

(51) Int. Cl.

| | |
|---|---|
| ***F02M 53/06*** | (2006.01) |
| ***F02M 61/18*** | (2006.01) |
| ***F02M 61/04*** | (2006.01) |

(52) U.S. Cl.

CPC ..... *F02M 53/06* (2013.01); *F02M 61/042* (2013.01); *F02M 61/1833* (2013.01); *F02M 61/188* (2013.01)

(58) Field of Classification Search

CPC .... F02M 55/008; F02M 53/06; F02M 61/042; F02M 61/1833; F02M 61/188

See application file for complete search history.

(56) References Cited

U.S. PATENT DOCUMENTS

| | | | | |
|---|---|---|---|---|
| 2,967,796 | A | 1/1961 | Raffel | |
| 4,347,822 | A | 9/1982 | Casey | |
| 4,354,640 | A * | 10/1982 | Hans | F02M 51/065 239/585.3 |
| 4,725,041 | A * | 2/1988 | Chauvin | F02M 51/005 251/129.15 |
| 4,982,902 | A * | 1/1991 | Knapp | F02M 51/065 239/585.3 |
| 6,481,641 | B1 | 11/2002 | Mieney | |
| 9,500,168 | B2 * | 11/2016 | Foege | F02M 43/00 |
| 9,587,606 | B2 | 3/2017 | Anders et al. | |
| 10,077,724 | B1 | 9/2018 | Kurtz et al. | |
| 2007/0028900 | A1 * | 2/2007 | Allen | F02M 61/08 123/531 |
| 2010/0102146 | A1 * | 4/2010 | Kitagawa | F02M 61/165 239/584 |

FOREIGN PATENT DOCUMENTS

DE 102013220791 B4 * 7/2015 ..... F02M 51/0675

OTHER PUBLICATIONS

Zhang, X. et al., "Fuel Injector," U.S. Appl. No. 15/841,036, filed Dec. 13, 2017, 31 pages.

Zhang, X. et al., "Methods and Systems for a Fuel Injector," U.S. Appl. No. 15/921,516, filed Mar. 14, 2018, 46 pages.

* cited by examiner

*Primary Examiner* — Tuongminh N Pham

(74) *Attorney, Agent, or Firm* — Geoffrey Brumbaugh; McCoy Russell LLP

(57) ABSTRACT

Methods and systems are provided for a fuel injector. In one example, a system may include an injector comprising two or more passages shaped to flow a mixture in opposite directions before injecting the mixture.

15 Claims, 5 Drawing Sheets

METHODS AND SYSTEMS FOR A FUEL INJECTOR

FIELD

The present description relates generally to a fuel injector comprising one or more features for increasing fuel heating prior to injection.

BACKGROUND/SUMMARY

In engines, air is drawn into a combustion chamber during an intake stroke by opening one or more intake valves. Then, during the subsequent compression stroke, the intake valves are closed, and a reciprocating piston of the combustion chamber compresses the gases admitted during the intake stroke, increasing the temperature of the gases in the combustion chamber. Fuel is then injected into the hot, compressed gas mixture in the combustion chamber. The mixture may be ignited via a spark or upon reaching a threshold pressure. The combusting air-fuel mixture pushes on the piston, driving motion of the piston, which is then converted into rotational energy of a crankshaft.

However, the inventors have recognized potential issues with such engines. As one example, fuel may not mix evenly with the air in the combustion chamber, leading to the formation of dense fuel pockets in the combustion chamber. These dense regions of fuel may produce soot as the fuel combusts. As such, engines may include particulate filters for decreasing an amount of soot and other particulate matter in their emissions. However, such particulate filters lead to increased manufacturing costs and increased fuel consumption during active regeneration of the filter.

Modern technologies for combating engine soot output and poor air/fuel mixing may include features for entraining air with the fuel prior to injection. This may include passages arranged in an injector body, as an insert into the engine head deck surface, or integrated in an engine head. Ambient air mixes with the fuel, cooling the injection temperature, prior to delivering the mixture to the compressed air in the cylinder. By entraining cooled air with the fuel prior to injection, a lift-off length is lengthened and start of combustion is retarded. This limits soot production through a range of engine operating conditions, reducing the need for a particulate filter.

However, the inventors herein have recognized potential issues with such injectors. As one example, the previously described fuel injectors may no longer sufficiently prevent soot production to a desired level in light of increasingly stringent emissions standards. Additionally, the previously described fuel injectors may only limit soot production in diesel engines, where air/fuel have a longer duration of time to mix before combustion than in spark-ignited engines. Additionally, cooling fuel may not be desired and fuel injectors may come packaged with a heat exchanger configured to heat the fuel mixture. This may increase manufacturing costs and packaging requirements.

In one example, the issues described above may be addressed by a system for an injector comprising a first passage configured to flow a mixture in a first direction, a second passage fluidly coupled to the first passage and shaped to flow the mixture in a second direction, and a third passage fluidly coupled to the second passage and shaped to flow the mixture in a third direction. In this way, the mixture may serpentine in the injector, which may increase heat transfer between the mixture and surfaces of the injector.

As one example, the injector is a fuel injector positioned to inject a fuel mixture into a combustion chamber. The fuel injector may be heated via combustion chamber gases, wherein surfaces of the fuel injector may transfer heat with the fuel mixture in the first, second, and third passages. As such, the fuel may be heated and the fuel injector surfaces may be correspondingly cooled without inclusion of a heat exchanger. By doing this, soot production may be decreased and/or prevented and packaging requirements of the fuel injector may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-3B are shown approximately to scale, although other relative dimensions may be used, if desired.

DETAILED DESCRIPTION

Figure 2:
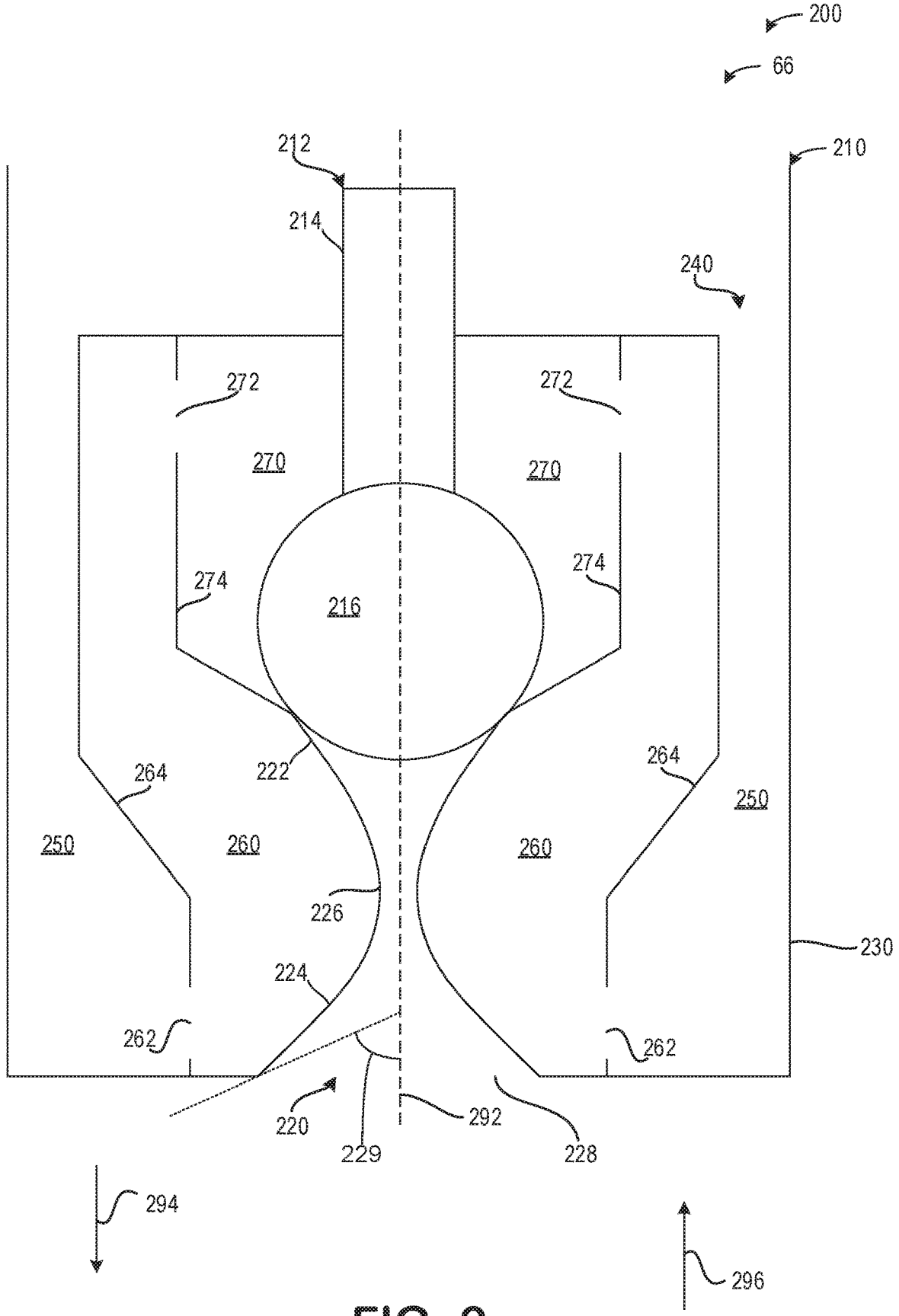
FIG. 2 illustrates a cross-section of a fuel injector of the engine.
Figure 3A:
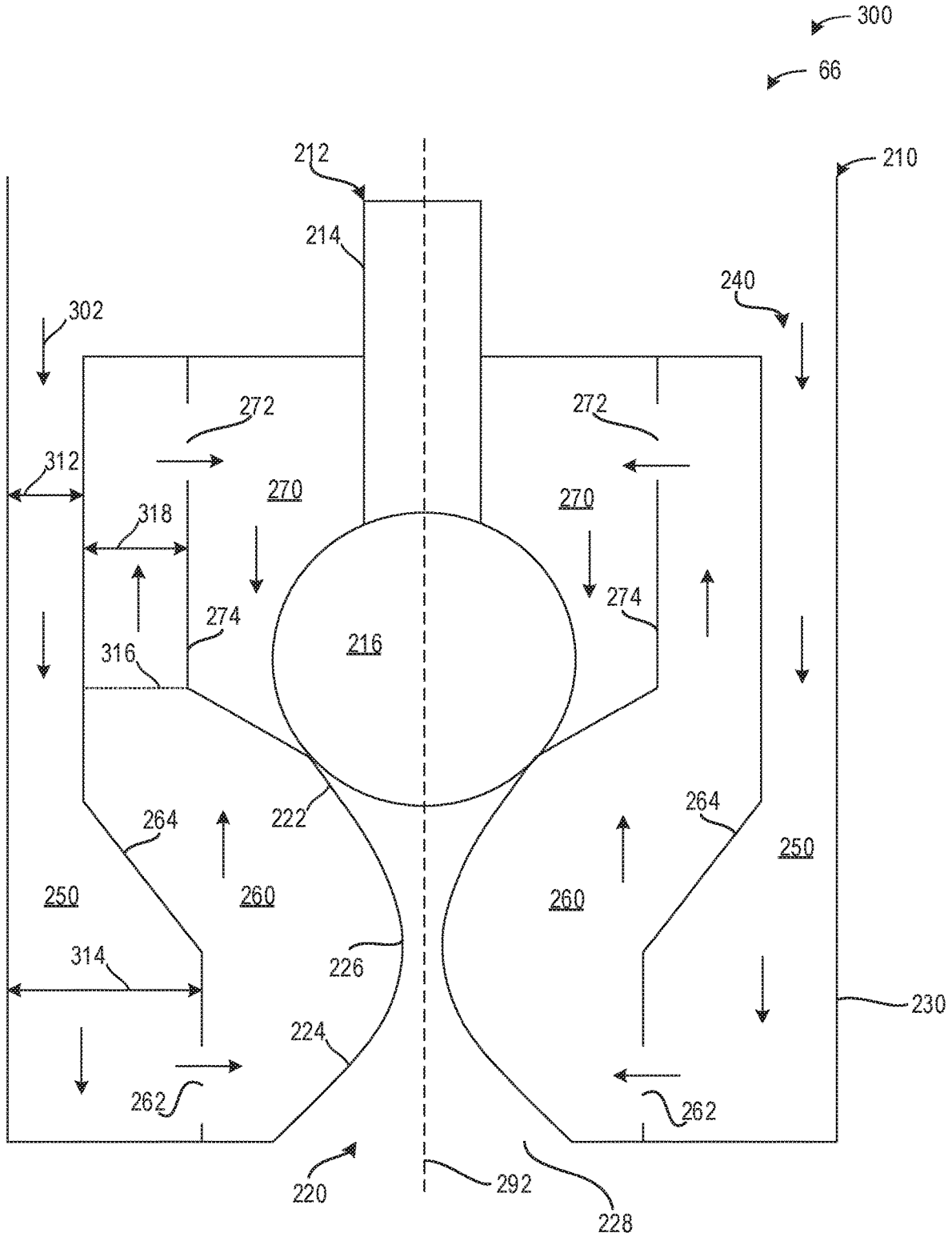
FIGS. 3A and 3B illustrate an example of fuel flow through the fuel injector during closed and open positions, respectively.
Figure 3B:
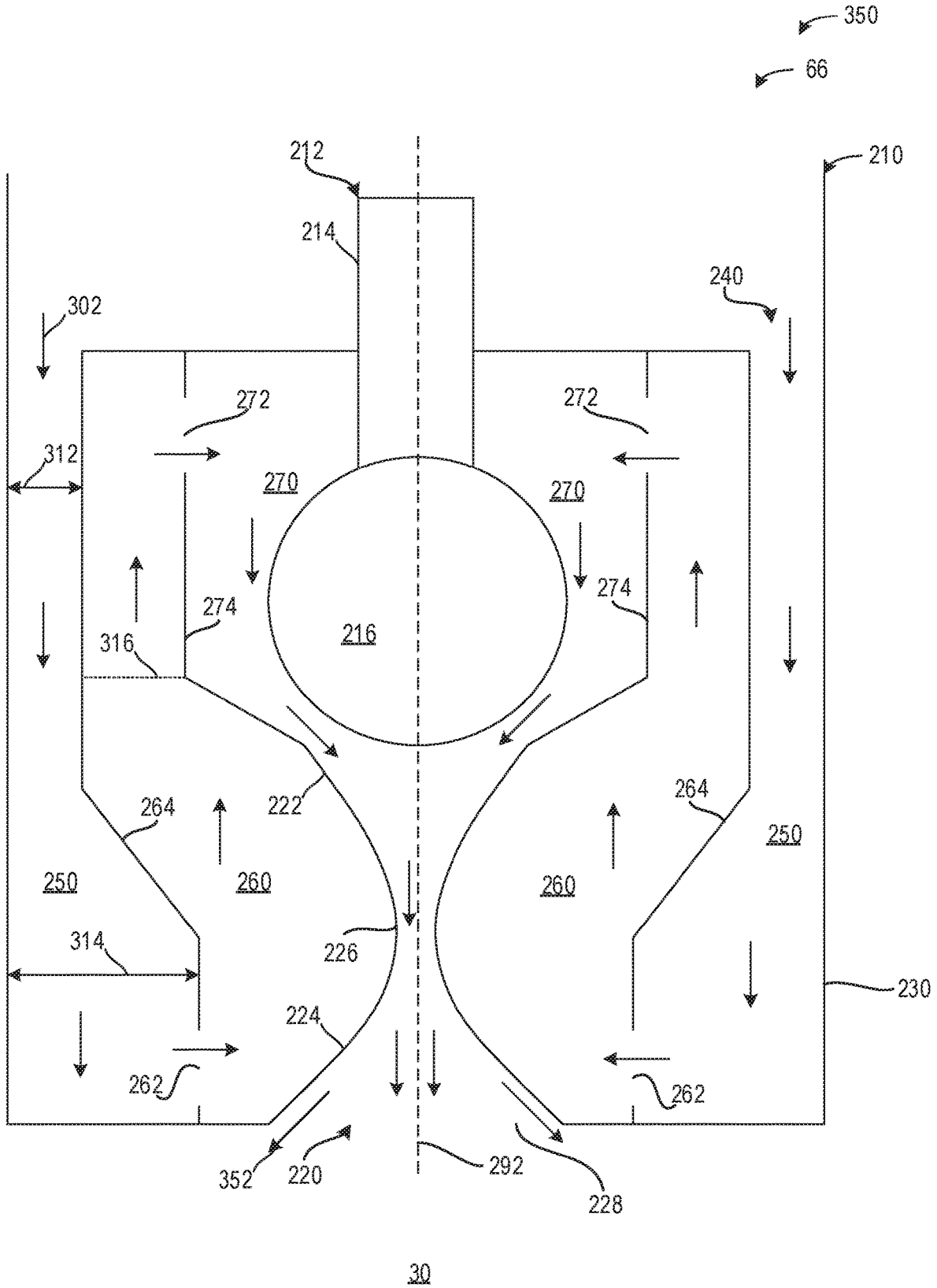
Figure 4:
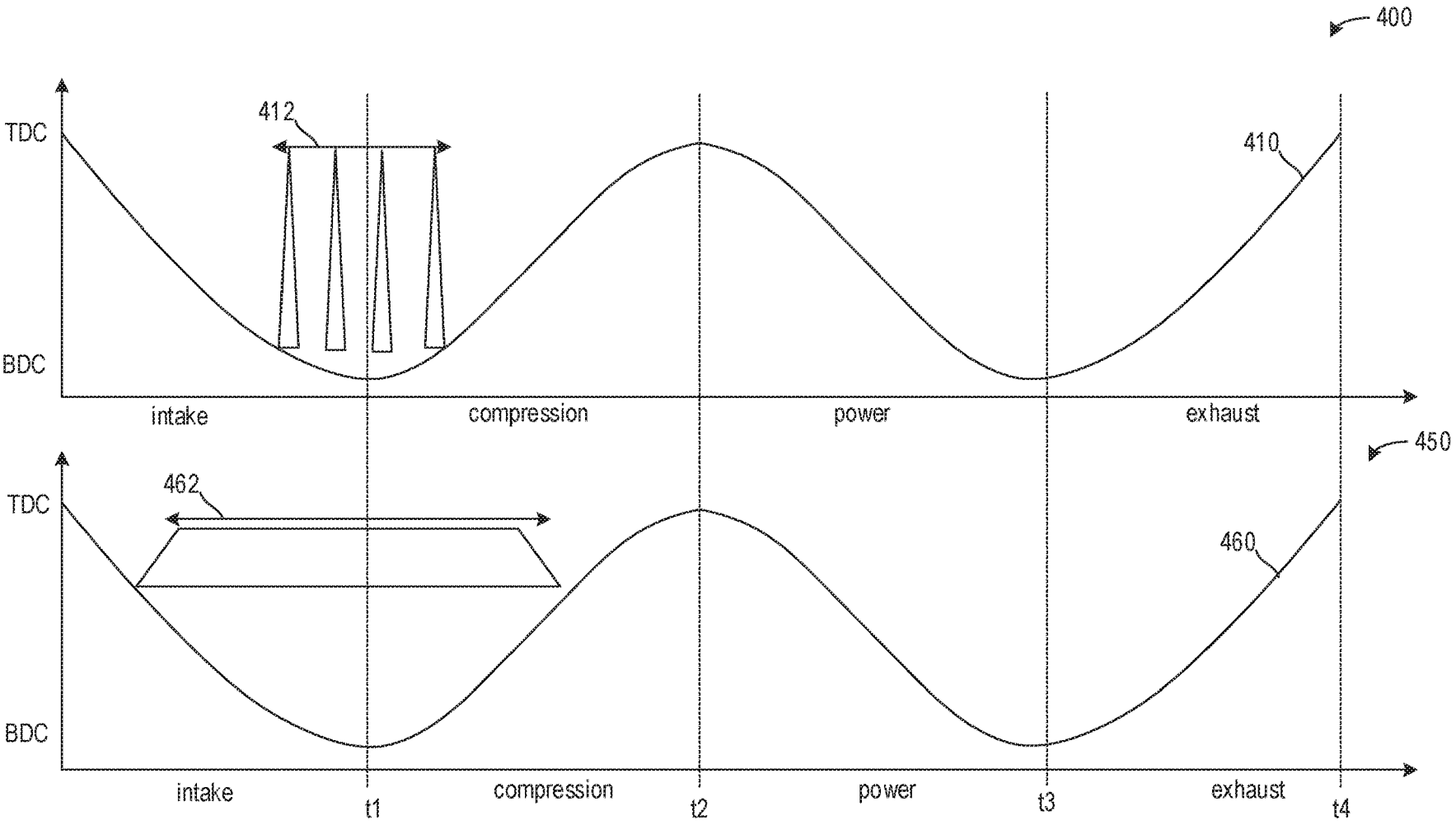
FIG. 4 illustrates a comparison of a single engine cycle and fuel injection window of a previous example of a fuel injector and the fuel injector of the present disclosure.

The following description relates to systems and methods for a fuel injector. The fuel injector may be positioned to inject into a combustion chamber of an engine, such as the engine illustrated in FIG. 1. The fuel injector may be positioned in a side wall or top wall (e.g., fire deck) of the combustion chamber. The fuel injector may comprise a plurality of passages shaped to adjust a fuel flow path to increase thermal communication between a fuel mixture and surfaces of the fuel injector. In one example, the plurality of passages may serpentine the fuel mixture such that its flow direction is reversed more than once. A cross-section of the fuel injector is illustrated in FIG. 2. An example of the fuel flow path in closed and open positions of the fuel injector are shown in FIGS. 3A and 3B, respectively. A comparison of a fuel injection window for a previous example of a fuel injector and the fuel injector of the present disclosure during an engine cycle are shown in FIG. 4.

FIGS. 1-3B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Note that FIGS. 3A and 3B show arrows indicating where there is space for gas to flow, and the solid lines of the device walls show where flow is blocked and communication is not possible due to the lack of fluidic communication created by the device walls spanning from one point to another. The walls create separation between regions, except for openings in the wall which allow for the described fluid communication.

Figure 1:
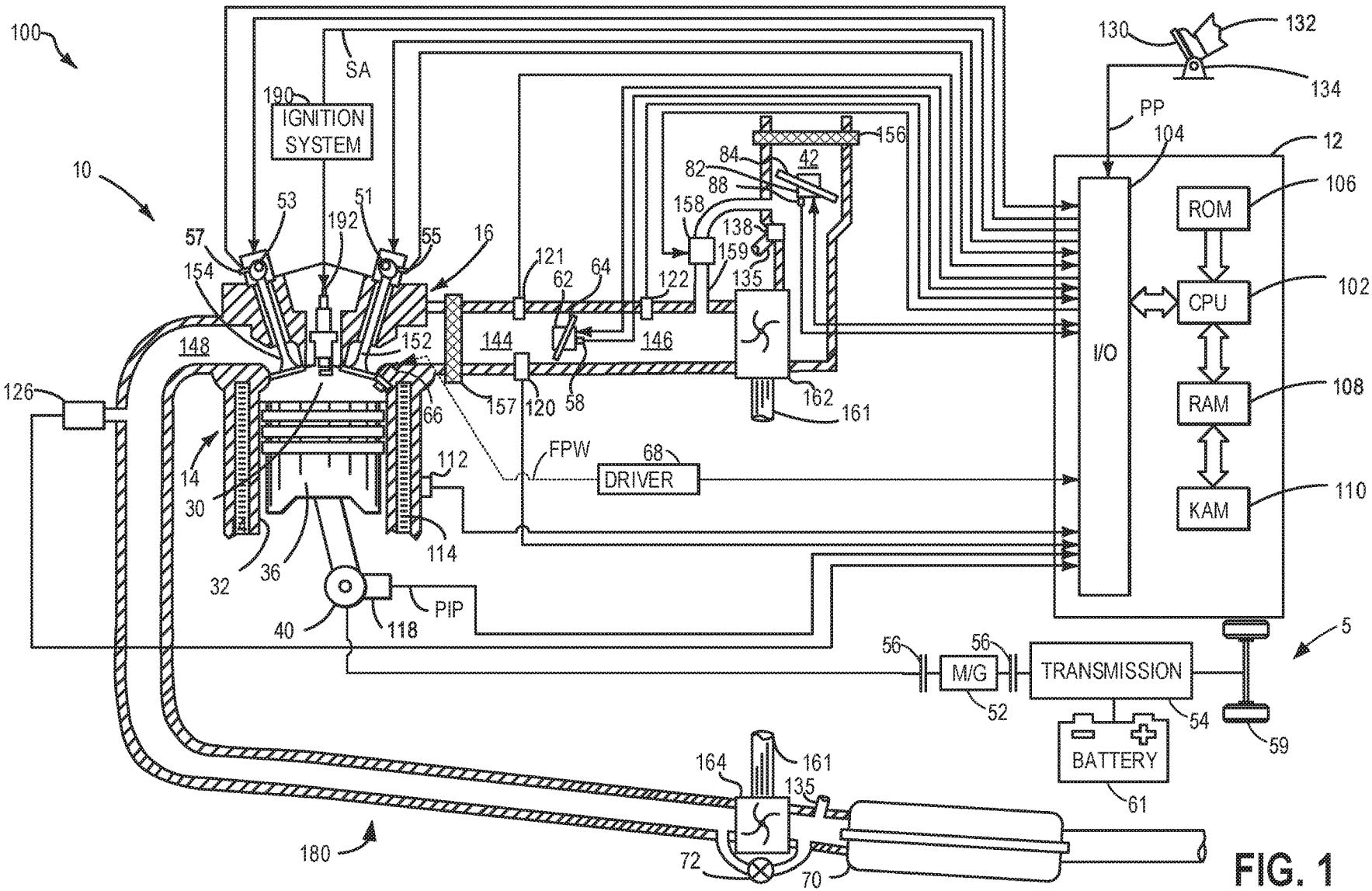
FIG. 1 illustrates a schematic of an engine included in a hybrid vehicle.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore 20 may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

The injector 66 may be shaped to flow a mixture of liquids and/or gases through one or more of its passages to be injected into the combustion chamber 30. The mixture may include one or more of alcohol, different octane rated fuels, diesel, cleaners, catalysts, and the like.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 59. Electric machine 52 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, adjusting operation of the fuel injector 66 may include signaling to an actuator of the injector to inject more or less fuel.

Turning now to FIG. 2, it shows an embodiment 200 of the fuel injector 66 comprising a fuel injector tip 210. As such, components previously introduced may be similarly numbered in subsequent figures. As shown in FIG. 1, the fuel injector 66 may be positioned to inject directly into a combustion chamber (e.g., combustion chamber 30 of FIG. 1). The fuel injector 66 may be position along a side wall of the combustion chamber and/or at a fire deck of the combustion chamber. In some examples, one or more of the fuel injector 66 comprising the fuel injector tip 210 may be arranged in the combustion chamber. Additionally or alternatively, some of the fuel injectors may be arranged on the fire deck and some may be arranged on side walls of the combustion chamber without departing from the scope of the present disclosure.

The fuel injector tip 210 may extend into and/or be exposed to a combustion chamber (e.g., combustion chamber 30 of FIG. 1). In some examples, the fuel injector tip 210 may be the only portion of the fuel injector 66 extending into the combustion chamber. Combustion chamber gases, including exhaust gas, compressed air, ambient air, and the like may enter portions of the fuel injector tip 210 during some operations of the fuel injector 66. In this way, the fuel injector tip 210 may thermally communicate with the combustion chamber and fluids and gases arranged therein.

The fuel injector tip 210 may comprise a fuel injector needle 212 shaped to actuate along a central axis 292 of the fuel injector tip 210. The fuel injector needle 212 may comprise a stem 214 physically coupled to a head 216. The stem 214 may be driven by an actuator of the fuel injector 200 based on signals from a controller, such as controller 12 of FIG. 1. For example, the stem 214, and therefore the head 216, may be moved in a first direction, shown by arrow 294, to form a seal between the head 216 and a nozzle passage 220, resulting in a closed position preventing a fuel injection to occur. The seal may be generated due to surfaces of the head 216 being pressed against surfaces of the nozzle passage 220, such as a nozzle seat of the nozzle passage 220. Alternatively, the stem 214 may be moved in a second direction, opposite the first, shown by arrow 296, away from the nozzle passage 220, to allow fuel to flow into the nozzle passage 220, resulting in an open position allowing a fuel injection to occur.

In one example, the fuel injector comprises a plurality of positions, including a fully closed position, a fully open position, and a plurality of partially open positions therebetween. The partially open positions may be shaped to inject less of a fuel mixture into the combustion chamber than the fully open position, wherein an amount of fuel injected may be proportional to a space formed between the head 216 and nozzle seat surfaces of the nozzle passage 220. For example, a greater the space between the head 216 and the nozzle passage 220 (e.g., the more the partially open position resembles the fully open position), corresponds to increasing the amount of fuel mixture injected.

The nozzle passage 220 may comprise a venturi shape, wherein the nozzle passage 220 comprises a venturi inlet 222, a venturi outlet 224, and a venturi throat 226 arranged between the venturi inlet 222 and venturi outlet 224. A cross-sectional flow-through area of the venturi inlet 222 may decrease in the first direction toward the venturi throat 226. A cross-sectional flow-through area of the venturi outlet 224 may increase in a direction away from the venturi throat 226. As such, static pressure at the venturi throat 226 may be relatively low compared to other regions of the nozzle passage 220.

The fuel injector tip 210 may comprise an outer body 230. The outer body 230 may be a portion of the fuel injector tip 210 exposed to combustion chamber conditions. Additionally, the outer body 230 may define an outer boundary of the fuel injector tip 210, wherein the outer body 230 is an outermost surface of the fuel injector tip 210. The outer body 230 may be impervious to fluids except for a location of the venturi outlet 224. That is to say, an opening 228 may be arranged in the outer body 230 corresponding to a location of the venturi outlet 224, such that fuel and/or other fluids and gases in the nozzle passage 220 may flow from the venturi outlet 224, through the opening 228, and into a combustion chamber. In one example, there are no additional inlets or other outlets other than the opening 228. As such, fuel and/or other gases and fluids may only flow out of the fuel injector tip 210 via the opening 228.

The outlet 228 may be shaped such that an angle of the outlet surface may be shaped to decrease fuel penetration. Additionally or alternatively, this may increase a lift-off length in radially outward directions relative to the central axis 292. As such, fuel pockets may be less likely to form in the combustion chamber, which may decrease soot output. More specifically, angle 229 may be formed between an extreme end of a surface of the venturi outlet 224 and the central axis 292. As such, the angle 229 may be shaped to dictate a radially range in which the injector 66 may inject into the combustion chamber. The angle 229 may be adjusted based on an arrangement of the injector 66 in the combustion chamber.

In some examples, the angle 229 may be between 5 and 90 degrees. In some examples, additionally or alternatively, the angle 229 may be between 50 and 85 degrees. In some examples, additionally or alternatively, the angle 229 may be between 60 and 80 degrees. In some examples, additionally or alternatively, the angle 229 may be between 65 and 80 degrees. In some examples, additionally or alternatively, the angle 229 may be between 70 and 80 degrees. In one example, the angle 229 is exactly 75 degrees.

The fuel injector tip 210 may comprise a plurality of fuel passages 240 shaped to direct a fuel mixture to the nozzle passage 220. The plurality of fuel passages 240 may be shaped to adjust a direction of a fuel mixture flow more than once to increase a fuel flow path length. By flowing the fuel mixture in a serpentine flow path, heat transfer within the fuel injector tip 210 may increase relative to other fuel injector tips with a more straightforward flow path. By increasing heat transfer, fuel may be warmer prior to being injected into the combustion chamber via the injector needle 212 and/or combustion chamber gases. In one example, the fuel temperature may increase to a point where flash boiling may occur, wherein the flash boiling may enhance spray atomization and may decrease penetration distance. Additionally, the relatively cool fuel may cool the injector needle 212, thereby mitigating a likelihood of the injector needle 212 overheating, which may decrease a likelihood of degradation.

The plurality of fuel passages 240 may comprise a first passage 250 in direct contact with the outer body 230. The first passage 250 may be also be referred to herein as an outer passage 250. The first passage and/or outer passage 250 may be a passage of the plurality of fuel passages 240 configured to receive a fuel mixture first, before any of the other passages of the plurality of fuel passages 240 from a fuel sac or the like of the fuel injector 66. As such, an inlet of the first passage 250 may be arranged in the injector 66 upstream of a second passage 260 and a third passage 270.

A fuel mixture in the first passage 250 may conduct heat transfer with at least the outer body 230. In one example, the outer body 230, which may be exposed, at least partially, to combustion chamber conditions (e.g., gases) hotter than the fuel mixture. As such, as the fuel mixture flows through the first passage 250, the fuel mixture may be heated by surfaces of the outer body 230. Therefore, the fuel mixture inside the first passage 250 may symbiotically cool the surfaces of the outer body 230, which may prevent a temperature of the outer body 230 from exceeding a threshold temperature (e.g., a temperature where degradation of the outer body 230 may occur) as the surfaces of the outer body 230 heat the fuel mixture. In this way, inclusion of a heat exchanger and/or cooling passages in the fuel injector 66 may not be necessary, thereby decreasing packaging constraints and a manufacturing cost.

The fuel mixture may flow from the first passage 250 to the second passage 260 via one or more lower openings 262. The lower openings 262 may be arranged in an intermediate body 264 of the fuel injector tip 210. The intermediate body 264 may be interior to the outer body 230. Further, the intermediate body 264 is arranged closer to the central axis 292 than the outer body 230. As such, the intermediate body 264 may completely separate the first passage 250 from the second passage 260. In one example, there are no additional inlets or other outlets between the first and second passages 250, 260 except for the lower opening 262.

The fuel mixture may enter the second passage 260 in a fourth direction angled to the central axis 292 before flowing in a second direction. In one example, the second direction is opposite the first direction of fuel mixture flow in the first passage 250 and the fourth direction is perpendicular to each of the first, second, and third directions. Additionally or alternatively, the fourth direction is parallel to a line normal to the lower openings 262. The fourth direction may direct the fuel mixture inwardly toward the center of the injector 66. As such, the fuel mixture in the second passage 260 may flow away from the combustion chamber and toward the injector needle 212. More specifically, the fuel mixture in the second passage 260 may flow along exterior surfaces of the nozzle passage 220. In one example, combustion chamber gases may heat the surfaces of the nozzle passage 220, which may heat portions of the fuel mixture in the second passage 260. Additionally, the fuel mixture may cool the surfaces of the nozzle passage 220, which may decrease a likelihood of the temperature of the nozzle passage 220 from exceeding the threshold temperature. As such, a likelihood of degradation (e.g., cracking, deformation, etc.) may be reduced.

The fuel mixture may flow from the second passage 260 to the third passage 270 via one or more upper openings 272. The upper openings may be arranged in an inner body 274 of the fuel injector tip 210. The inner body 274 may be interior to each of the outer body 230 and the intermediate body 264 and closer to the central axis 292 than the outer body 230 and the intermediate body 264. In one example, the outer body 230 is the outermost surface of the fuel injector tip 210, the inner body 274 is the innermost surface, and the intermediate body 264 is arranged therebetween. In this way, surfaces of the outer body 230 and the intermediate body 264 may define the first passage 250, surfaces of the intermediate body 264 and the inner body 274 may define the second passage 260, and surfaces of the inner body 274 and nozzle passage 220 may define the third passage 270. Fuel within a respective passage may thermally communicate with walls defining the passage. For example, the fuel mixture in the first passage 250 may thermally communicate with the outer body 230 and the intermediate body 264. Additionally, a combination of the first 250, second 260, and third 270 passages may serpentine a fuel mixture flow from a radially outer portion of the injector 66 toward a radially inner portion closer to the central axis 292.

The fuel mixture may enter the third passage 270 in a fifth direction angled relative to the central axis 292 before flowing in a third direction. In one example, the third direction is opposite the second direction and substantially identical to the first direction and the fifth direction is perpendicular to each of the first, second, and third directions. The fifth direction may be substantially similar to the fourth direction. Additionally or alternatively, a line normal to the upper openings 272 may be further away from combustion chamber than the line normal to the lower openings 262. In this way, the arrow 294 may also represent the third direction. As such, the fuel mixture in the third passage 270 may flow toward the combustion chamber and away from the injector needle 212. As shown, the fuel mixture in the third passage may come into direct contact with the injector needle 212.

It will be appreciated that the embodiment 200 may be a cross-section of the fuel injector 66. As such, each of the first passage 250, second passage 260, and third passage 270 may be annular and concentric with the central axis 292. In one example, the fuel injector tip 210 comprises reflectional symmetry about the central axis 292.

In some examples of the fuel injector 66, the nozzle passage 220 may be the only outlet of the fuel injector. As such, the fuel injector 66 may inject fuel to the combustion chamber via only the nozzle passage 220. In some examples, additionally or alternatively, the nozzle passage 220 may be one of a plurality of nozzle passages, each shaped to inject fuel to a different location of the combustion chamber.

In some embodiments, additionally or alternatively, the fuel injector tip 210 may comprise one or more air entraining passages extending through the outer body 230 to the venturi throat 226 of the nozzle passage 220. The one or more air entraining passages may traverse one or more of the first passage 250, second passage 260, and third passage 270 before reaching the venturi throat 226. However, the one or more air entraining passages may be hermetically sealed from the first passage 250, second passage 260, and third passage 270 such that combustion chamber gases in the one or more air entraining passages may not mix with a fuel mixture in one or more of the first passage 250, second passage 260, and third passage 270. By including one or more air entraining passages in the fuel injector tip 210, heating of the fuel mixture in the first passage 250, second passage 260, and third passage 270 may increase due to heat transfer between the fuel mixture and surfaces of the air entraining passages. Furthermore, mixing between the fuel mixture and the combustion chamber gases may increase prior to injecting the fuel mixture into the combustion chamber.

Turning now to FIG. 3A, it shows an embodiment 300 of the fuel injector tip 210 in a fully closed position. The injector needle 212 may be moved to a lower position where the head 216 may be pressed against the inner body 274, thereby sealing the third passage 270 from the nozzle passage 220. In this way, the fuel mixture may not flow from the third passage 270 to the nozzle passage 220, and as a result, a fuel injection does not occur.

That is to say, the fuel mixture (illustrated by arrows 302) flows through the first passage 250 between the outer body 230 and the intermediate body 264 toward one or more of the lower openings 262. The first passage 250 comprises a first width 312 where the fuel mixture may enter the first passage 250. As the fuel mixture flows through the first passage 250, a width of the first passage 250 may increase to a second width 314 near the lower openings 262. By increasing a width of the first passage 250, more heat transfer may occur between the fuel mixture and the outer body 230.

The fuel mixture may flow through the lower openings 262 to the second passage 260. The second passage 260 may comprise a plurality of widths upstream of dashed line 316 relative to a direction of fuel mixture flow, wherein the plurality of widths adjusts based on a cross-sectional flow-through area of the nozzle passage 220. At any rate, each width of the plurality of widths may be greater than a third width 318 of the second passage 260 downstream of the dashed line 316. In one example, the third width 318 may be greater than the first width 312 and less than the second width 314.

The fuel mixture may flow through the upper openings 272, thereby exiting the second passage 260 and entering the third passage 270. In the third passage 270, the fuel mixture 270 may flow adjacent to and around the injector needle 212. This may include flowing around one or more of the stem 214 and the head 216. In the fully closed position shown in the example of FIG. 3A, the fuel mixture may remain in the third passage 270 and may be blocked from flowing to the nozzle passage 220.

Turning now to FIG. 3B, it shows an embodiment 350 of the fuel injector tip 210 in an at least partially open position. In one example, the fuel injector tip 210 may be in a fully open position in the example of FIG. 3B. The fuel mixture flow in the fully open position of the fuel injector tip 210 may be substantially similar to the fuel mixture flow described in FIG. 3A where the fuel injector tip 210 is in the fully closed position, except that in the fully open position, fuel may flow from the third passage 270 to the nozzle passage 220 due to the head 216 being spaced away from the inner body 270.

The fuel mixture may enter the nozzle passage 220, which comprises a venturi shape. More specifically, the nozzle passage 220 may be shaped to decrease a penetration of the fuel mixture when injected into the combustion chamber 30. Arrows 352 illustrate a radial direction of the fuel mixture during the injection. This may be due to a diameter of the venturi outlet 224. In one example, a diameter of the venturi outlet 224 may be greater than a diameter of the venturi inlet 222, which may allow the fuel mixture to spread out and flow more radially compared to a more narrow venturi outlet 224. In this way, the injector needle may be held in the fully open position during an injection, rather than oscillated between fully open and fully closed to limit fuel injection penetration as shown in previous examples of fuel injectors. By doing this, an injection window (e.g., a movement range of the piston in which fuel may be injected) and fuel economy may increase, as will be described in greater detail below.

Turning now to FIG. 4, it shows time-sequences 400 and 450 illustrating injection windows for a previous example of a fuel injector and the fuel injector of the present disclosure, respectively. The previous example of the fuel injector may not comprise the first, second, and third passages along with the nozzle passage described above with respect to FIGS. 2, 3A, and 3B.

Plot 410 illustrates a piston position for a combustion chamber of a vehicle comprising the previous example of a fuel injector. Plot 460 illustrates a piston position for a combustion chamber of a vehicle comprising the fuel injector of the present disclosure (e.g., vehicle 5 of FIG. 1). At any rate, the pistons of each of the examples may move similarly, from top-dead center (TDC) to bottom-dead center (BDC) prior to and at t1. TDC may be a position of the piston nearest to a cylinder head while BDC may be a position of the piston farthest from the cylinder.

During the intake stroke, intake air and other gases (e.g., EGR) may be drawn into the combustion chamber. Additionally, a fuel injection may begin during the intake stroke. As shown on plot 410, injection window 412 begins near the end of the intake stroke, once the piston position is out of range of a fuel penetration distance of the fuel injections of the previous example fuel injector. That is to say, the previous example fuel injector may begin injecting fuel once the piston is far enough from the fuel injector such that a fuel injection may not contact the piston.

Between t1 and t2, the fuel injection window 412 continues on plot 410. However, the fuel injection window 412 closes shortly after BDC as the piston oscillates toward TDC. As such, fuel impingement onto the piston may be a primary factor when timing the fuel injection window in vehicles comprising the previous example fuel injector. Additionally, due to the fuel penetration of the previous example fuel injector, the fuel injection may be a plurality of fuel injections to minimize the penetration distance. This may demand charging and discharging of a solenoid or other actuator of the fuel injector, which may increase energy demands and demand more complex controls.

Comparatively, a fuel injection window 462, illustrated on plot 460, may begin mid-way through the intake stroke, farther from BDC than the fuel injection window 412. The fuel injection window 462 may continue into the compression stroke, where the fuel injection window 462 may close nearer to TDC than the fuel injection window 412. This may be due to a wide angle of an outlet of the nozzle passage of the fuel injector. The wide angle (e.g., angle 229 of FIG. 2) may allow the fuel injection to penetrate less and flow in a radially direction more than the previous example fuel injector. As such, the fuel injection may be maintained during the entire fuel injection window 462. This may decrease energy demands and decrease controls needed to operate the fuel injector.

In this way, a fuel injector may comprise a plurality of passages arranged therein to reverse the flow of a fuel mixture more than once. The serpentine flow path may allow the fuel mixture to flow through the fuel injector for a greater duration of time before being injected into the combustion chamber while decreasing packaging restraints. The technical effect of increasing a fuel flow path in a fuel injector is to increase a fuel mixture temperature prior to injecting the fuel, which may increase fuel mixing with combustion chamber gases and decrease emissions. Furthermore, the fuel flow path may be elongated without increasing a packaging size of the injector, which may allow the fuel mixture to heat up more before being injected. This may increase fuel economy and decrease manufacturing costs as a heat exchanger may not be included in the packaging of the fuel injector. Furthermore, the fuel temperature may increase to a temperature where flash boiling may occur, which may increase spray atomization and decrease a penetration distance.

An embodiment of a system, comprising an injector comprising a first passage shaped to flow a mixture in a first direction, a second passage fluidly coupled to the first passage and shaped to flow the mixture in a second direction, and a third passage fluidly coupled to the second passage and shaped to flow the mixture in a third direction. A first example of the system further includes where the first direction and the third direction are identical to one another and opposite to the second direction. A second example of the system, optionally including the first example, further includes where the third passage is fluidly coupled to a venturi passage. A third example of the system, optionally including the first and/or second examples, further includes where the first passage is arranged distal to a central axis of the injector relative to the second passage and third passage, and where an inlet to the first passage is arranged upstream in the injector of the second passage and third passage so that the first passage receives the mixture before the second and third passages, where the first passage extends in the first direction toward a plurality of lower openings arranged adjacent to the outlet, and where the lower openings form an inlet to the second passage from the first passage, where a line normal to the lower openings is arranged perpendicular to the central axis so that the mixture flows in a fourth direction parallel to the line through the lower openings, the fourth direction perpendicular to the first direction. A fourth example of the system, optionally including one or more of the first through third examples, further includes where the second passage is arranged closer to the central axis than the first passage, the second passage extending in the second direction, away from the lower openings and toward a plurality of upper openings arranged further inward in the injector than the lower openings, where a line normal to the upper openings is arranged perpendicular to each of the first, second, and third directions and parallel to the fourth direction so that the mixture flows in a fifth direction through the upper openings, the fifth direction arranged parallel to the fourth direction, and where the upper openings form an inlet into the third passage from the second passage, the third passage arranged closer to the central axis than the first and second passages. A fifth example of the system, optionally including one or more of the first through fourth examples, further includes the first, second, and third directions are parallel to one another and wherein the mixture is a fuel mixture. A sixth example of the system, optionally including one or more of the first through fifth examples, further includes a width of the first passage increases in the first direction, toward an outlet of the injector. A seventh example of the system, optionally including one or more of the first through sixth examples, further includes where the second passage is arranged between the first passage and third passage, and where the third passage is the only passage shaped to flow the mixture out of the injector, with an outlet of the injector arranged at an end of the third passage.

An embodiment method, comprising flowing a fuel mixture in a first direction in a first passage of a tip of a fuel injector, flowing the fuel mixture in a second direction, opposite the first direction, in a second passage of the tip, and flowing the fuel mixture in a third direction, opposite the second direction and identical to the first direction, in a third passage of the tip, before injecting the fuel mixture from a venturi passage of the tip, the fuel injector positioned to inject fuel directly into a combustion chamber. A first example of the method further includes where flowing the fuel mixture in the first direction in the first passage includes flowing the fuel mixture through the first passage toward the combustion chamber, and further comprising flowing the fuel mixture in a fourth direction from the first passage to the second passage via one or more lower openings, the fourth direction arranged perpendicular to each of the first and second directions. A second example of the method, optionally including the first example, further includes where flowing the fuel mixture in the second direction in the second passage includes flowing the fuel mixture through the second passage away from the combustion chamber, and further comprising flowing the fuel mixture in a fifth direction from the second passage to the third passage via one or more upper openings, the fifth direction arranged perpendicular to each of the first and second directions. A third example of the method, optionally including the first and/or second examples, further includes where flowing the fuel mixture in the third direction in the third passage further includes flowing the fuel mixture through the venturi passage fluidly coupled to the third passage when an injector needle is in an at least partially open position, and wherein flowing the fuel mixture in the third direction in the third passage further includes blocking the fuel mixture from flowing through the venturi passage when the injector needle is in a fully closed position, where the venturi passage is an only passage fluidly coupling the fuel injector to the combustion chamber. A fourth example of the method, optionally including one or more of the first through third examples, further includes where heating the fuel mixture as it passes through each of the first, second, and third passages via transferring heat between the fuel mixture and surfaces of the fuel injector, wherein the surfaces of the fuel injector are heated by combustion chamber gases in the combustion chamber. A fifth example of the method, optionally including one or more of the first through fourth examples, further includes where continuously injecting the fuel mixture through portions of each of an intake stroke and compression stroke of a piston of the combustion chamber. A sixth example of the method, optionally including one or more of the first through fifth examples, further includes where flowing the fuel mixture in the first passage, second passage, and third passage includes flowing the fuel mixture in a serpentine shape through the injector before injecting the fuel mixture directly into the combustion chamber.

An embodiment of a fuel injector comprising an undulating fuel flow path comprising a first passage shaped to receive a fuel mixture from distal a combustion chamber, and where the first passage is shaped to flow the fuel mixture in a first direction toward the combustion chamber, a second passage shaped to receive the fuel mixture via one or more lower openings fluidly coupling the second passage to the first passage at a position proximal to the combustion chamber, and where the second passage is shaped to flow the fuel mixture in a second direction away from the combustion chamber, and a third passage shaped to receive the fuel mixture via one or more upper openings fluidly coupling the third passage to the second passage at a position distal to the combustion chamber, and where the third passage is shaped to flow the fuel mixture in a third direction toward the combustion chamber, and where the third passage is fluidly coupled to a nozzle outlet, the nozzle outlet comprising a venturi shape. A first example of the fuel injector further comprises where an injector needle positioned within the third passage, where the fuel mixture flow from the third passage to the nozzle outlet is adjusted via a position of the injector needle, where the injector is adjustable between a closed position where a head of the injector needle is positioned against a venturi inlet of the nozzle outlet and an open position where the head of the injector needle is positioned away from the venturi inlet, where the fuel mixture is stopped from flowing to the nozzle outlet when the injector needle is in the closed position and the fuel mixture flows to and through the nozzle outlet when the injector needle is in the open position. A second example of the fuel injector, optionally including the first example, further includes where the nozzle outlet includes the venturi inlet and a venturi outlet with a venturi throat positioned between the venturi inlet and venturi outlet, the venturi throat being narrower than each of the venturi inlet and venturi outlet. A third example of the fuel injector, optionally including the first and/or second examples, further includes where the exhaust gas heats surfaces of the nozzle outlet and the injector needle, and where the injector needle transfers heat with the fuel mixture in the third passage, and where surfaces of the nozzle outlet transfer heat with the fuel mixture in the second passage. A fourth example of the fuel injector, optionally including one or more of the first through third examples, further includes where the undulating fuel flow path comprises no additional inlets or other outlets other than the first passage and the nozzle outlet.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an injector comprising a first passage shaped to flow a mixture in a first direction, a second passage fluidly coupled to the first passage and shaped to flow the mixture in a second direction, and a third passage fluidly coupled to the second passage and shaped to flow the mixture in a third direction, wherein the third passage is fluidly coupled to a venturi passage, wherein a venturi outlet of the venturi passage ejects the mixture from the injector, and wherein the second passage is configured to flow the mixture along exterior surfaces of the venturi passage, including an exterior surface of the venturi outlet that is perpendicular to a central axis of the injector and is exposed to the second passage, where the venturi outlet is positioned closer to a combustion chamber than a venturi inlet, wherein a width of the first passage increases in the first direction, toward the venturi outlet of the injector, and wherein the width of the first passage is largest at an end of the first passage that is closest to the venturi outlet, and wherein the first direction and the third direction are identical to one another and opposite to the second direction.

2. The system of claim 1, wherein the first passage is arranged distal to the central axis of the injector relative to the second passage and the third passage, wherein an inlet to the first passage is arranged upstream in the injector of the second passage and the third passage so that the first passage receives the mixture before the second and third passages, wherein the first passage extends in the first direction toward a plurality of lower openings arranged adjacent to the venturi outlet, wherein the plurality of lower openings form an inlet to the second passage from the first passage, and wherein a line normal to the lower openings is arranged perpendicular to the central axis of the injector so that the mixture flows in a fourth direction parallel to the line normal to the plurality of lower openings, the fourth direction perpendicular to the first direction.

3. The system of claim 2, wherein the second passage is arranged closer to the central axis of the injector than the first passage, the second passage extending in the second direction, away from the plurality of lower openings and toward a plurality of upper openings arranged further inward in the injector than the plurality of lower openings, wherein a line normal to the plurality of upper openings is arranged perpendicular to each of the first, second, and third directions and parallel to the fourth direction so that the mixture flows in a fifth direction through the plurality of upper openings, the fifth direction arranged parallel to the fourth direction, and wherein the plurality of upper openings form an inlet into the third passage from the second passage, the third passage arranged closer to the central axis of the injector than the first and second passages.

4. The system of claim 1, wherein the first, second, and third directions are parallel to one another and wherein the mixture is a fuel mixture.

5. The system of claim 1, wherein the second passage is arranged between the first passage and the third passage, and wherein the venturi passage is the only passage shaped to flow the mixture out of the injector, with the venturi outlet arranged at an extreme end of the venturi passage and the injector.

6. A fuel injector, comprising:

an undulating fuel flow path, comprising:

a first passage shaped to receive a fuel mixture from an end arranged distal to a combustion chamber, wherein the first passage is shaped to flow the fuel mixture in a first direction toward the combustion chamber;

a second passage shaped to receive the fuel mixture via one or more lower openings fluidly coupling the second passage to the first passage at a position proximal to the combustion chamber, wherein the second passage is shaped to flow the fuel mixture in a second direction away from the combustion chamber; and a third passage shaped to receive the fuel mixture via one or more upper openings fluidly coupling the third passage to the second passage at a position distal to the combustion chamber, wherein the third passage is shaped to flow the fuel mixture in a third direction toward the combustion chamber, and wherein the third passage is fluidly coupled to a nozzle outlet that is a part of a nozzle passage, the nozzle outlet comprising a venturi shape, wherein the nozzle outlet includes the venturi inlet and a venturi outlet with a venturi throat positioned between the venturi inlet and the venturi outlet, and wherein the nozzle passage is configured to eject the fuel mixture directly to the combustion chamber, wherein the second passage is configured to flow the fuel mixture along exterior surfaces of the nozzle passage, including an exterior surface of the venturi outlet that is perpendicular to a central axis of the fuel injector and is exposed to the second passage, where the venturi outlet is positioned closer to the combustion chamber than the venturi inlet, wherein a width of the first passage increases in the first direction, toward the venturi outlet of the injector, and wherein the width of the first passage is largest at an end of the first passage that is closest to the venturi outlet.

7. The fuel injector of claim 6, further comprising an injector needle positioned within the third passage, where the fuel mixture flow from the third passage to the nozzle outlet is adjusted via a position of the injector needle, wherein the injector is adjustable between a closed position where a head of the injector needle is positioned against a venturi inlet of the nozzle outlet and an open position where the head of the injector needle is positioned away from the venturi inlet, and wherein the fuel mixture is stopped from flowing to the nozzle outlet when the injector needle is in the closed position and the fuel mixture flows to and through the nozzle outlet when the injector needle is in the open position.

8. The fuel injector of claim 7, wherein the venturi throat is narrower than each of the venturi inlet and the venturi outlet.

9. The fuel injector of claim 6, wherein the first, second, and third passages are concentric relative to a central axis of the fuel injector.

10. The fuel injector of claim 6, wherein the undulating fuel flow path comprises no additional inlets or other outlets other than the first passage and the nozzle outlet.

11. A system, comprising:

an injector comprising a first passage shaped to flow a mixture in a first direction, a second passage fluidly coupled to the first passage and shaped to flow the mixture in a second direction, and a third passage fluidly coupled to the second passage and shaped to flow the mixture in a third direction, wherein the third passage is fluidly coupled to a venturi passage, wherein a venturi outlet of the venturi passage ejects the mixture from the injector, and wherein the second passage is configured to flow the mixture along exterior surfaces of the venturi passage, including the venturi outlet, wherein a width of the first passage increases in the first direction, toward the venturi outlet of the injector, and wherein the width of the first passage is largest at an end of the first passage that is closest to the venturi outlet, and wherein an interior surface of an outer body of the injector is directly exposed to the first passage.

12. The system of claim 11, wherein the exterior surfaces of the venturi passage include an exterior surface of the venturi outlet that are perpendicular to a central axis of the injector, and where the venturi outlet is positioned closer to a combustion chamber than both a venturi inlet and a venturi throat of the venturi passage.

13. The fuel injector of claim 6, wherein an interior surface of an outer body of the injector is directly exposed to the first passage.

14. The fuel injector of claim 13, wherein an exterior surface of the outer body is at least partially exposed to the combustion chamber.

15. The fuel injector of claim 14, further comprising an intermediate body positioned between the outer body and the nozzle outlet.

* * * * *